United States Patent [19]

van Herten et al.

[11] 4,095,887

[45] Jun. 20, 1978

[54] DETECTOR CIRCUIT FOR ELECTROPHOTOGRAPHIC COPIER

[75] Inventors: Jozef Marie van Herten, Venlo; Bastiaan Bernard Boele Eertink, Grubbenvorst, both of Netherlands

[73] Assignee: Oce-van der Grinten N.V., Venlo, Netherlands

[21] Appl. No.: 710,785

[22] Filed: Aug. 2, 1976

[30] Foreign Application Priority Data

Aug. 8, 1975 Netherlands ..... 7509460

[51] Int. Cl.[2] ..... G03G 21/00

[52] U.S. Cl. ..... 355/3 BE; 250/548; 323/21; 340/259; 355/41

[58] Field of Search ..... 323/21; 355/3 BE, 14, 355/16, 41, 68, 83; 250/548; 340/259

[56] References Cited

U.S. PATENT DOCUMENTS

| | | | |
|---|---|---|---|
| 2,956,487 | 10/1960 | Giaimo | 355/14 |
| 3,359,483 | 12/1967 | Biard | 323/21 |
| 3,740,563 | 6/1973 | Reichard | 250/548 |
| 3,743,405 | 7/1973 | Morse et al. | 355/68 X |
| 3,926,625 | 12/1975 | van der Sterren | 355/16 X |
| 3,947,117 | 3/1976 | Basu et al. | 355/83 X |

*Primary Examiner*—A. D. Pellinen

*Attorney, Agent, or Firm*—Albert C. Johnston; Gerard F. Dunne

[57] ABSTRACT

In electrophotographic copying apparatus utilizing a photoconductive belt having markings regularly spaced apart on its back side for control of the copying operations by moving past a detector comprising a light source and a photoelement to generate signal pulses, the detector is made to perform reliably notwithstanding variations of the sensitivity of the photoelement, or of the light emission, by the provision of a circuit for emitting a detector signal proportional to the amount of light sensed by the photoelement together with a signal modifying circuit that maintains an output signal level corresponding to the average value of the detector signal and a control circuit responsive to the output signal level for controlling the intensity of the light source.

9 Claims, 1 Drawing Figure

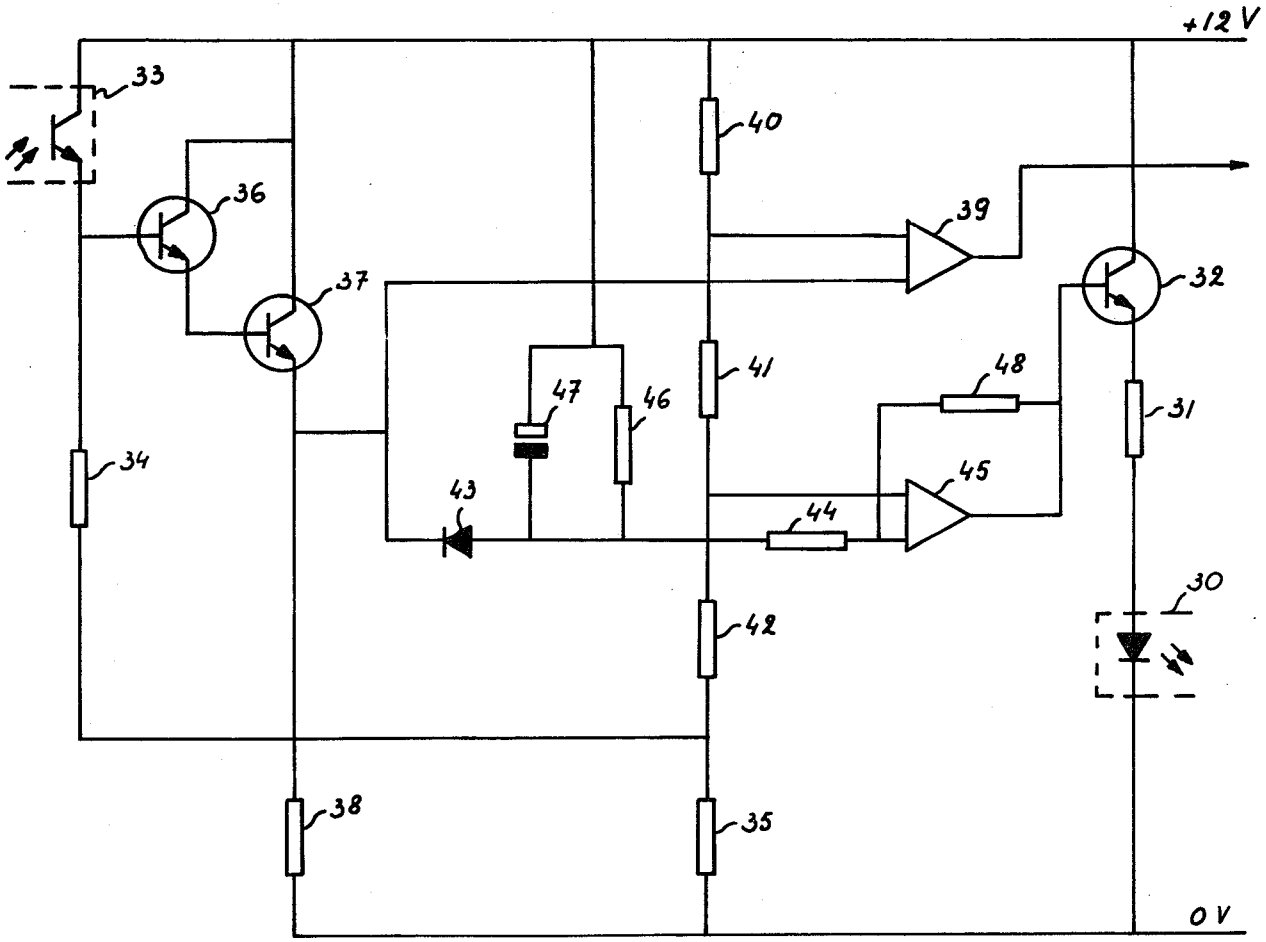
+12 V
0 V
30
31
32
33
34
35
36
37
38
39
40
41
42
43
44
45
46
47
48

DETECTOR CIRCUIT FOR ELECTROPHOTOGRAPHIC COPIER

This invention relates to an electrophotographic copying apparatus of the type utlizing a photoconductive belt provided on one side thereof with regularly spaced markings having a coefficient of reflection that differs from the coefficient of reflection of said side, and in which a detector including a light source and a photoelement located adjacent to said one side of the belt is provided for generating a signal pulse each time a marking passes the detector.

An electrophotographic apparatus provided with such a photoconductive belt is described, e.g., in U.S. Pat. No. 3,926,625, and a control system making use of markings on the photoconductive belt for controlling the electrophotographic process is disclosed in U.S. Pat. No. 3,912,390.

The markings on the belt may have the form of mechanical cams which cooperate with microswitches, or of perforations in nonused parts of the belt, which may cooperate with a small lamp and a photocell installed respectively at the front and at the back of the belt. In an especially desirable form of the markings, they are small areas provided at the back of the photoconductive belt and which have a light reflection strongly contrasting with the reflectivity of the back surface. In the case of a light-colored back, for instance, small black areas may be employed, or in the case of a dark-colored back silver-colored areas may be provided. The detection of such markings is effected by the action of a small lamp and a photocell, both of which are installed opposite to the back of the belt so that the photocell responds to the light reflected by the back. In this way the cooperating markings and detecting system are located entirely at the back side of the belt where they do not impede any processing that may be effected at the front or photoconductive side of the belt.

The described system for detecting markings on the belt normally functions quite satisfactorily, but troubles may still occur because of decay in the sensitivity of the photocell or of variations of the ambient conditions, for instance temperature fluctuations, which cause the photocell to become more sensitive or less sensitive. The variation of sensitivity of the photocell may become so great that, at a constant intensity of the light from the small lamp, the photocell no longer will distinguish between the reflection of a marking and the reflection of the normal back surface of the belt.

The object of the present invention is to provide a circuit by which troubles arising from such variations in the sensitivity of the photocell can be eliminated.

This object is achieved according to the invention by a circuit in which the output of the detector is connected to a signal-modifying circuit that has an output signal level corresponding to the average value of the output signal of the detector, and the output of the signal-modifying circuit is connected to the input of a control circuit which controls the light-intensity of the light source.

In this way, the amount of light radiated by the light source can be regulated so that it is always sufficient to keep the output signal of the detector substantially constant at a desired value. It also results that changes occurring in the average coefficient of reflection of the belt surface do not affect the magnitude of the average output signal of the photoelement. Consequently, the response of the detector to the presence of a marking is always the same, and the reliability of the detector is considerably enhanced.

According to a preferred embodiment of the invention the signal-modifying circuit comprises a low-pass filter, by which in a simple way assurance is provided that the response of the detector to a marking will not affect the control of the intensity of the light source.

An embodiment of a circuit for carrying out the invention is illustrated schematically in the accompanying drawing.

In the circuit shown in the drawing, a light source 30 in the form of a LED is connected via a resistor 31 and a transistor 32 to a 12 V d.c. voltage source. The resistor 31 serves for limiting the voltage over the LED 30, while the transistor 32 constitutes an impedence converter which controls the voltage over the LED 30 and in this way controls its light-emission, all as will be explained more fully below.

The LED 30 emits light to the back of a photoconductive belt (not shown), from which some of the light may be reflected to a phototransistor 33 which is connected in series with two resistors 34 and 35 to the 12 V d.c. voltage source. The emitter terminal of the phototransistor 33 is connected in Darlington configuration to the base of a transistor 36 having its emitter connected to the base of a transistor 37 which in turn has its emitter connected to the terminal 0 V via a resistor 38. The collectors of the transistors 32, 36 and 37 are connected with the terminal +12 V.

In this way it is achieved that the voltage emitted by the transistor 37 is in proportion to the quantity of light reflected by the back of the photoconductive belt onto the phototransistor 33.

The emitter of the transistor 37 is connected to one of the two input terminals of an operational amplifier 39. The emitter voltage received in this amplifier is compared with a reference voltage which is determined by a voltage divider composed of the resistors 40, 41, 42 and 35, for which purpose the other input terminal of the operational amplifier 39 is connected to the connection lead between the resistors 40 and 41. Consequently, the output signal of the operational amplifier 39 is dependent on the quantity of light reflected by the back of the photoconductive belt. The output signal of the amplifier 39 is used as a pulse signal for indicating that a small area or mark having reflectivity different from that of the normal belt surface is passing along the phototransistor 33. A system for utilzing this signal pulse in the control of an electrophotographic apparatus is described in detail in U.S. Pat. No. 3,912,390.

The emitter of the transistor 37 is also connected, via a diode 43 and a resistor 44, to one input of an operational amplifier 45. The other input of this amplifier is connected to the connection lead between the resistors 41 and 42, so that the voltage in this lead is used as a reference voltage. Consequently, a signal is generated in the output of the operational amplifier 45 which is dependent on the voltage difference in the two inputs. This amplifier output is connected to the base of the transistor 32 through which voltage is passed to the LED 30.

The connection lead between the diode 43 and the resistor 44 is connected to the terminal +12 V via an RC-circuit, or low-pass filter, consisting of a resistor 46 and a capacitor 47. By an appropriate selection of characteristics of this RC-circuit, assurance is provided that the voltage in the first input of the operational amplifier 45 cannot change suddenly as can the voltage in the first input of the operational amplifier 39.

Since the small areas or marks having different reflectivity are small in relation to the area of the back of the belt, the quantity of light which falls on the phototransistor 33 is mainly determined by the average reflectivity of the belt back. This causes the capacitor 47 to be charged up to a corresponding level which, via the amplifier 45, determines the resistance of the transistor 32, and thus also the light emission of the LED 30.

When a small area or mark with deviating reflectivity is passing the phototransistor 33, the voltage in the emitter of the transistor 37 will change temporarily and consequently the output signal of the operational smplifier 39 will also change temporarily. This voltage variation, however, is too short in duration to cause a voltage variation in the first input of the operational amplifier 45, due to the effect of the RC-circuit 46, 47. It therefore will not change the condition of the transistor 32.

The voltage in the emitter of the transistor 37 will also be changed when the characteristic response of the LED 30 or of the phototransistor 33 changes. This change, however, is of longer duration than a change induced by a passing mark on the belt, and it causes a change of the voltage over the capacitor 47 with a resulting change of the condition of the transistor 32.

When for instance the phototransistor 33 becomes less sensitive, or the light emission of the LED 30 becomes lower, the emitter voltage of the transistor 37 will drop to a lower level, as a result of which the voltage over the capacitor 47 becomes higher. The operational amplifier 45 then senses a greater voltage difference and generates a greater output signal which renders the transistor 32 less insulating, thus increasing the current to the LED 30 and causing it to emit more light so that the decrease of sensitivity of the phototransistor is compensated.

On the other hand, an increase of the light-sensitivity of the phototransistor 33 or of the light emission of the LED 30 will increase the emitter voltage of the transistor 37, with the result that there is a smaller voltage difference between the inputs of the operational amplifier 45, thus also a lower base voltage in the transistor 32, and consequently a lower voltage over the LED 30.

It should also be noted that the output of the operational amplifier 45 is negatively recoupled via a resistor 48 to the lead between resistor 44 and amplifier 45, in order to stabilize the operation of the amplifier 45.

In the illustrated embodiment of the invention the reference voltage for the operational amplifier 45 is always higher than the variable voltage, but this is only a matter of choice. It will be evident to any skilled artisan that a reverse condition can also be employed, and also that particulars of the circuit shown and described can be modified in other ways without departing from the substance of the invention, which is intended to be defined by the appended claims.

What is claimed is:

1. In an electrophotographic copying apparatus comprising a photoconductive belt having on one side thereof regularly spaced markings the reflectivity of which differs from the average reflectivity of the said belt side, detector means including a light source and a photoelement located adjacent to said belt side for generating a signal pulse each time a marking passes the detector means and a copying control circuit to receive the signal pulses, the improvement which comprises said detector means including means for emitting a detector signal proportional to the amount of light sensed by said photoelement, a signal modifying circuit separated from said copying control circuit and including means for maintaining an output signal at a level corresponding to the average value of said detector signal and a detector light control circuit including means responsive to said output signal for controlling the intensity of said light source.

2. Apparatus according to claim 1, said means for maintaining said output signal level comprising a low-pass filter on a lead connecting said signal emitting means with said light control circuit.

3. Apparatus according to claim 2, said low-pass filter comprising a resistor and a capacitor connected in parallel between said lead and a terminal of a source of a control voltage for said light control circuit.

4. Apparatus according to claim 1, said signal-modifying circuit comprising a circuit separating element connected with said signal emitting means and from which element a lead extends to said light control circuit and a resistor and a capacitor connected in parallel between said lead and a voltage source.

5. Apparatus according to claim 1, said light control circuit comprising a voltage differential amplifier and an impedance converter.

6. Apparatus according to claim 5, said impedance converter comprising a transistor having its base connected with the output of said amplifier, its collector connected with a voltage source and its emitter connected with said light source.

7. Apparatus according to claim 1, said signal emitting means comprising a plurality of transistors connected together in Darlington configuration, said photoelement being a photo-transistor and constituting the first of the said transistors.

8. In an electrophotographic copying apparatus comprising a photoconductive belt having on one side thereof regularly spaced markings the reflectivity of which differs from the average reflectivity of the said belt side, detector means including a light source and a photoelement located adjacent to said belt side for generating a signal pulse each time a marking passes the detector means and a copying control circuit to receive the signal pulses, the improvement which comprises said detector means including means for emitting a detector signal proportional to the amount of light sensed by said photoelement, said signal emitting means comprising a plurality of transistors connected together in Darlington configuration, said photoelement being a phototransistor and constituting the first of said transistors, a signal modifying circuit separated from said copying control circuit and including means for maintaining an output signal at a level corresponding to the average value of said detector signal and a detector light control circuit including means responsive to said output signal for controlling the intensity of said light source, said signal-modifying circuit comprising a diode connected to the emitter of the last of said transistors and from which diode a lead extends to said light control circuit and a resistor and a capacitor connected in parallel between said lead and a voltage source, said light control circuit comprising a voltage differential amplifier and an impedance converter.

9. Apparatus according to claim 8, said impedance converter comprising a transistor having its base connected with the output of said amplifier, it collector connected with a voltage source and its emitter connected with said light source.

* * * * *